US009114447B2

(12) United States Patent
Yamamoto

(10) Patent No.: US 9,114,447 B2
(45) Date of Patent: Aug. 25, 2015

(54) EXTRUSION PRESS

(75) Inventor: Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 235 days.

(21) Appl. No.: 13/514,348

(22) PCT Filed: Dec. 14, 2009

(86) PCT No.: PCT/JP2009/071086
§ 371 (c)(1),
(2), (4) Date: Jun. 7, 2012

(87) PCT Pub. No.: WO2011/074106
PCT Pub. Date: Jun. 23, 2011

(65) Prior Publication Data
US 2012/0244239 A1 Sep. 27, 2012

(51) Int. Cl.
*B21C 23/21* (2006.01)

(52) U.S. Cl.
CPC ..... *B21C 23/211* (2013.01)

(58) Field of Classification Search
CPC .... B21C 23/21; B21C 23/211; B21C 23/212; B21C 23/215; B29C 47/0021; B29C 47/004; B29C 47/0801
USPC ..... 425/258, 352–355; 72/253.1, 271–273
See application file for complete search history.

(56) References Cited

U.S. PATENT DOCUMENTS 5,753,879 A * 5/1998 Yang et al. ..... 219/69.12
8,650,926 B2 * 2/2014 Yamamoto et al. ..... 72/271

FOREIGN PATENT DOCUMENTS

| | | | |
|---|---|---|---|
| CN | 2360563 | Y | 1/2000 |
| JP | 5-31526 | A | 2/1993 |
| JP | 8-206727 | A | 8/1996 |
| JP | 10-5853 | A | 1/1998 |
| JP | 3074669 | B2 | 8/2000 |
| JP | 2007-160335 | A | 6/2007 |
| WO | 2008/087891 | A1 | 7/2008 |

OTHER PUBLICATIONS

Chinese Office Action dated Jul. 7, 2014 along with an English translation from corresponding Chinese Patent Application No. 200980162878.2.
Office Action with the English translation dated Dec. 25, 2013 for Chinese Patent Application No. 200980162878.2.

* cited by examiner

*Primary Examiner* — Joseph S Del Sole
*Assistant Examiner* — Thukhanh T Nguyen
(74) *Attorney, Agent, or Firm* — DLA Piper LLP (US)

(57) ABSTRACT

An extrusion press includes an end platen, a fixed platen arranged at the rear thereof, a tie rod configured to link the end platen and the fixed platen, a die, a container loaded with a billet, an extrusion stem configured to press the billet, a cross-head attached with the extrusion stem, and an extrusion drive configured to reciprocate the extrusion stem. The extrusion drive includes a rotatable wire drum driven by an electric extrusion main motor and drives the extrusion stem to perform extrusion molding by winding the wire by rotating the wire drum.

6 Claims, 11 Drawing Sheets

A-A

B-B (a)

(b)

EXTRUSION PRESS

BACKGROUND OF THE INVENTION

1. Technical Field

The present invention relates to an extrusion press and in particular, to an extrusion press device that molds an aluminum alloy, etc., by extrusion molding via a die and, in more particular, to an electrically driven extrusion press that applies the electrically driven system adopted in an injection molding machine of synthetic resin (or a die cast machine that die-casts an aluminum alloy).

2. Background Art

An extrusion press is used to mold a metal product, such as an aluminum sash, by extrusion molding. In the conventional extrusion press, a billet, which is a material, is loaded within a fixed container, extruded by a stem (or extrusion stem) driven by a ram cylinder, and passed through a die attached to the outlet of the container, and thereby, the billet is molded so as to have a predetermined cross-sectional shape. The billet loaded on such a molding machine is supplied by a billet loader. The billet loader is configured so as to grasp the billets one by one sent from a billet carrier arranged on the lateral side of the molding machine and move the billet to a billet load port of the container and then the billet is sent out by the stem and loaded on the container in a state where the billet and the load port are aligned and molded by being extruded under pressure.

Many of the products molded by extrusion molding by the extrusion press are elongated, such as an aluminum sash, and in the case of an elongated product, the billet is extruded for a long time by the stem, and therefore, the ram cylinder that pushes the stem uses a hydraulic system capable of long strokes under high pressure. However, such a conventional extrusion press device uses hydraulic pressure as power (for example, see Patent Literature 1, Patent Literature 2), and therefore, there are problems with regard to the environment (noise, oil spill, etc.), energy saving (running cost), etc. In order to solve such problems, it is desired to realize an electric drive that is used in an injection molding machine of synthetic resin (or die cast machine that die-casts an aluminum alloy). In the case of an electric drive, in general, it is necessary to convert rotational motion of an electric motor, which is a drive in the first stage, into rectilinear motion or reciprocating rectilinear motion.

However, such a mechanism (ball screw and ball nut etc.) that converts rotational motion into rectilinear motion in place of a conventional hydraulic cylinder device capable of continuously outputting a large output capacity required for the extrusion press, for example, 9,800 kN (1,000 tf), or a large output electric servomotor is not realized. Due to this, the electrically driven system is not applied to the extrusion press.

Further, the extrusion press comprises various kinds of devices that move, such as an extrusion stem slide, shear device, die slide device (shear), die changer, and billet loader, and conventionally, these devices adopt the hydraulic system as the ram system does.

The conventional extrusion press is a machine that produces extruded products by driving a plurality of hydraulic press devices by motors and pumps that consume electric power. Not only during the extrusion process but also during processes other than the extrusion process, for example, processes of, such as discard cutting and removal and insertion of the next billet, the same pump and motor are used as a drive source. The pump and motor and auxiliary pump and motor used for extrusion that utilize hydraulic equipment are always in the idling operation even when not necessary for the operation of the device directly, and therefore, power consumption loss occurs.

Further, when a machine user uses a machine for many years, the user needs to perform maintenance and inspection inevitably in order to maintain and manage the machine and it is considered that the time required for maintenance is by far longer in the case where the drive source is a hydraulic source than in the case where only an electric motor is used. The reason is as follows. When the hydraulic equipment is used for many years, trouble, such as deterioration of the hydraulic oil, wear of valves, and oil spill from pipe connections, relates to many parts, such as pumps, valves, manifolds, and pipes, and therefore, it takes much time to troubleshoot the cause and take measures.

Further, when the hydraulic source is used, the hydraulic oil flows out (leak, discharge, etc.) at the time of maintenance, etc., and therefore, the machine operability and working environment deteriorate and there is a risk of fire because containers and dies are used in a high-temperature environment. It is of course possible to use flame resistant hydraulic oil (water-glycol fluid etc.), however, ordinarily the hydraulic oil is used under high pressure in order to make the machine compact and the flame resistant hydraulic oil (water-glycol fluid etc.) is not suitable for use, and therefore, not normally used.

As described above, as the drawbacks of the conventional hydraulic drive system, there are problems as follows. (1) The hydraulic oil is used as a medium, and therefore, it is difficult to realize accurate speeds and positions as in the case of the mechanical operation. (2) The amount of energy consumption is comparatively large and cooling water is required to prevent the oil temperature from rising, and therefore, the running cost is increased. (3) The number of components the circuit pressure of which is high is large and the noise during the operation is high. (4) Since hydraulic oil is used, there exit problems of maintenance, environment, and cost resulting from leak of the hydraulic oil and problems of environment and cost accompanying the disposal of the hydraulic oil.

The extrusion presses are classified into the conventional system (conventional type: billets are supplied between the end surface of the container and the tip end surface of the stem, including the direct type and the indirect type) (for example, see Patent Literature 1), the short stroke system (including the front loading system (for example, see Patent Literature 2) and the rear loading system which are classified based on the position where billets are supplied), etc. The present invention can be applied to either type. In the front loading type, the container is moved to the stem side and billets are supplied in the gap between the end surface of the container and the die and the rear loading type differs from the front loading type in that the stem is moved in the horizontal or vertical direction and billets are supplied in the gap formed when the stem moves (between the container and the cross-head).

CITATION LIST

Patent Literature

[PTL 1] Japanese Unexamined Patent Publication (Kokai) No. 8-206727

[PTL 2] Japanese Unexamined Patent Publication (Kokai) No. 10-5853

[PTL 3] Japanese Unexamined Patent Publication (Kokai) No. 2007-160335

SUMMARY OF INVENTION

Technical Problem

As described above, the conventional hydraulic extrusion press has problems of poor precision, inefficient energy consumption, adverse influence on the environment, etc., and therefore, the electric extrusion press that solves these problems is required. The present invention has been made in view of the circumstances described above and an object thereof is to improve precision, energy consumption, and maintenability/operability without adversely affecting the environment, and to reduce noise by providing an electric extrusion press.

Another object of the present invention is to provide an extrusion press electrically powered in a perfect manner.

Solution of Problem

In a first aspect of the present invention, in order to achieve the above-described objects, an extrusion press (10) comprises an end platen (1) arranged at the front end part in the lengthwise direction of the extrusion press (10), a fixed platen (2) arranged at the rear in the lengthwise direction in opposition to the end platen (1), a tie rod (4) that couples the end platen (1) and the fixed platen (2), a die (20) arranged so as to come into contact with the rear surface of the end platen (1), a container (3) arranged so as to oppose the die (20) and loaded with a billet (8), an extrusion stem (13) that presses the billet (8) loaded within the container (3), a crosshead (7) arranged at the front of the fixed platen (2) and to the front surface of which, the extrusion stem (13) is attached, and an extrusion drive that drives the crosshead (7) and the extrusion stem (13) attached to the crosshead (7) so as to reciprocate in the forward and backward directions. In the extrusion press (10), by pushing the extrusion stem (13) by an extrusion force of the extrusion drive, the billet (8) is put under pressure and extruded out via the die (20), and thus, a predetermined product is molded by extrusion molding. The extrusion drive comprises one or more wire drums (31) provided rotatably and one of the end parts of one or more wires (32) is fixed on the wire drum (31) and at the same time, the other end part of the wire (32) is connected mechanically to the crosshead (7) and by rotating the wire drum (31) to wind the wire (32), the crosshead (7) and the extrusion stem (13) are driven to move forward and the wire drum (31) is driven by an electric extrusion main motor (39).

In a preferred aspect, the extrusion drive further comprises an extrusion mobile part (15) linked to the crosshead (7) at one of end parts thereof, and an extrusion part (16) attached to the other end part of the extrusion mobile part (15) and on which the other end part of the wire (32) is fixed. The extrusion press (10) further comprises a crosshead fast moving mechanism (40) capable of causing the extrusion mobile part (15) to reciprocate back and forth and a wire winding device (42) capable of winding and feeding the wire (32) to and from the wire drum (31) by rotating the wire drum (31) in the forward and reverse directions, separately from the extrusion drive. In the stage at the time of start of the extrusion molding process, in which the billet (8) has moved forward and come into contact with the die (20) but no load of extrusion molding acts on the extension stem (13), when moving back the extrusion stem (13) and causing the extrusion stem (13) to move forward and back at a high speed, the extrusion stem (13) is driven at a high speed via the extrusion mobile part (15) by the crosshead fast moving mechanism (40) and at the same time, the wire winding device (42) is operated to wind and feed the wire (32).

At the time of the start of operation when driving the extrusion stem (13) at a high speed, it is preferable to operate the extrusion drive as well as the crosshead fast moving mechanism (40).

It is preferable for the extrusion press (10) to further comprise a container operating device (14) using an electric motor as a drive source and capable of driving the container (3) in the forward and backward directions, a shear device (27) using an electric motor as a drive source and for cutting a discard, and a die slide device (21) using an electric motor as a drive source and capable of moving the die (20). It is preferable to connect the extrusion main motor (39) to the wire drum (31) via a clutch coupling (38) and a speed reducer (36).

The extrusion press (10) further comprises a stem slider (11) using an electric motor as a drive source and capable of moving the extrusion stem (13) in order to provide a space for sending in the billet (8), between the crosshead (7) and the die (20).

The symbols in the parenthesis ( ) attached to each means described above indicate a correspondence with a specific means in the embodiments to be described later.

Advantageous Effects of Invention

The extrusion press of the present invention adopts the electric motor driven system, and therefore, an idling operation necessary for the hydraulic system is not necessary and it is possible to operate the motor only when each individual elemental device needs to be operated, and therefore, the effect of reducing power can be expected.

Since an electric motor is used as a drive source, it is only necessary to maintain the electric motor itself because the drive itself is the electric motor and the time and cost for maintenance and management are reduced because the number of parts to be maintained is smaller compared to that of a hydraulic source.

The leak of hydraulic oil does not occur and noise can be reduced, and therefore, the improvement of working environment is realized and the risk of fire can be avoided.

Further, controllability, such as positioning control, and operability are excellent.

The present invention may be more fully understood from the description of the preferred embodiments of the invention set forth below, together with the accompanying drawings.

DESCRIPTION OF EMBODIMENTS

Figure 1:
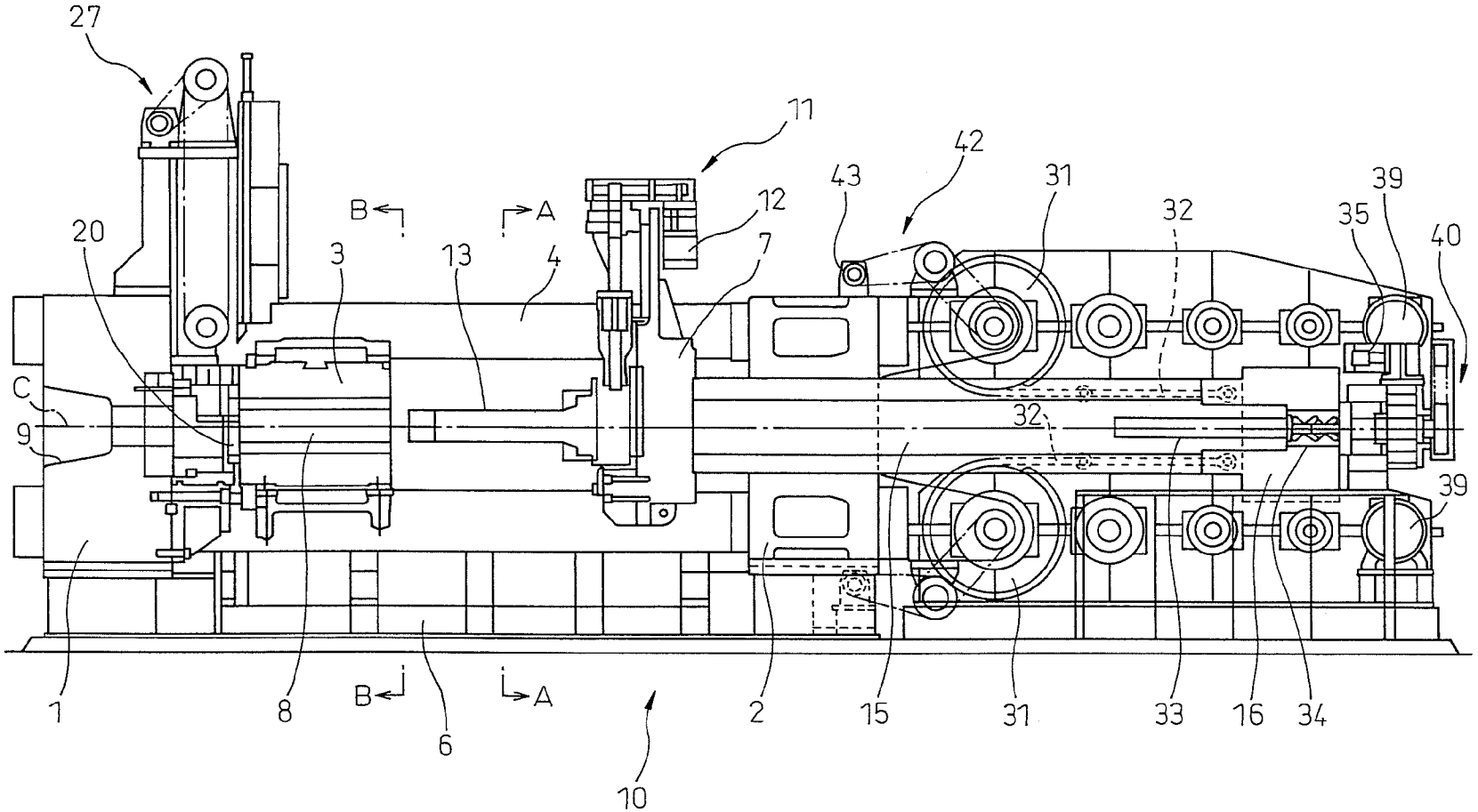
FIG. 1 is a side view showing an outline of the configuration of an extrusion press of a first embodiment.
Figure 2:
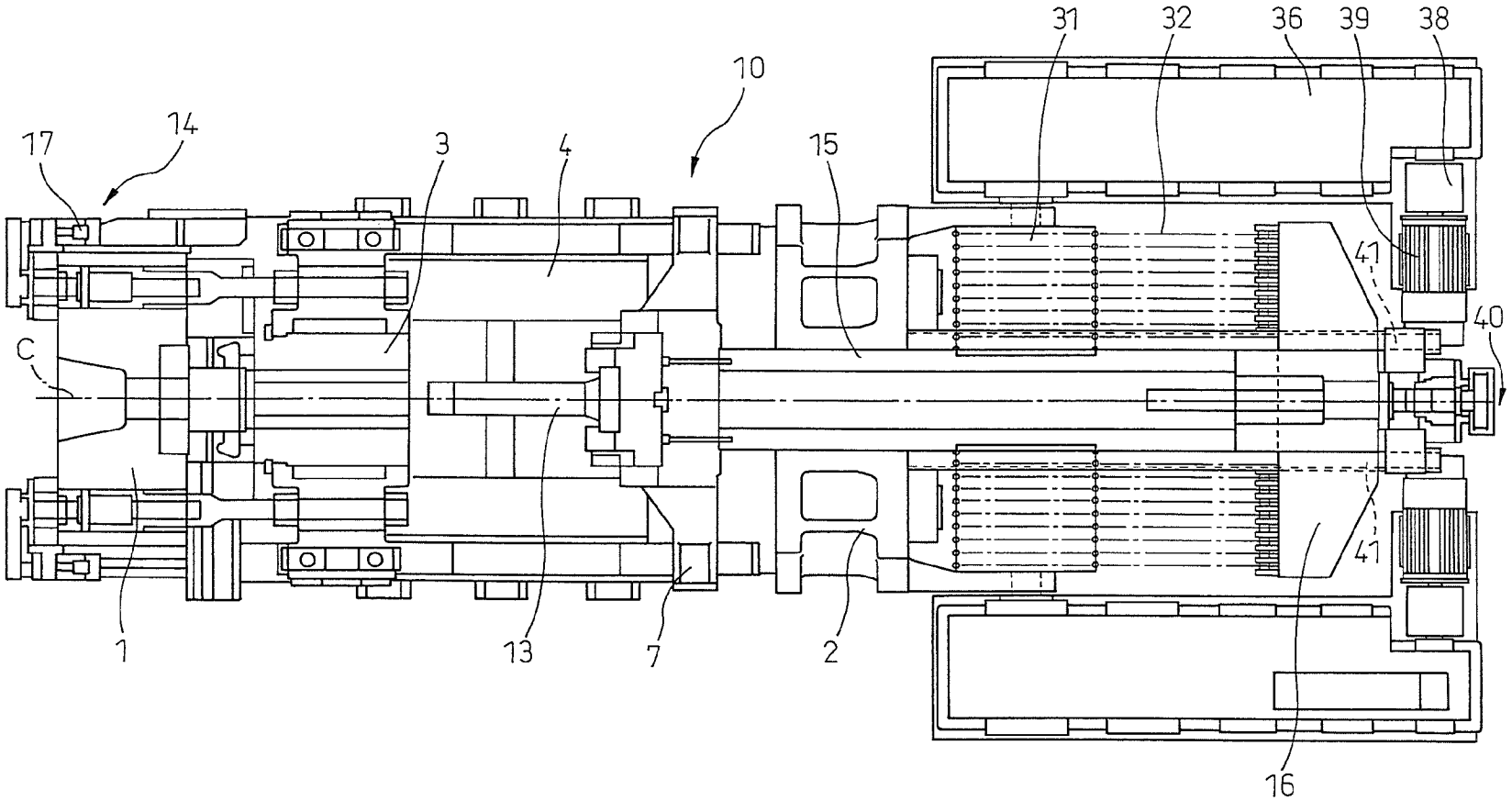
FIG. 2 is a plan view when the device in FIG. 1 is viewed from above.
Figure 3:
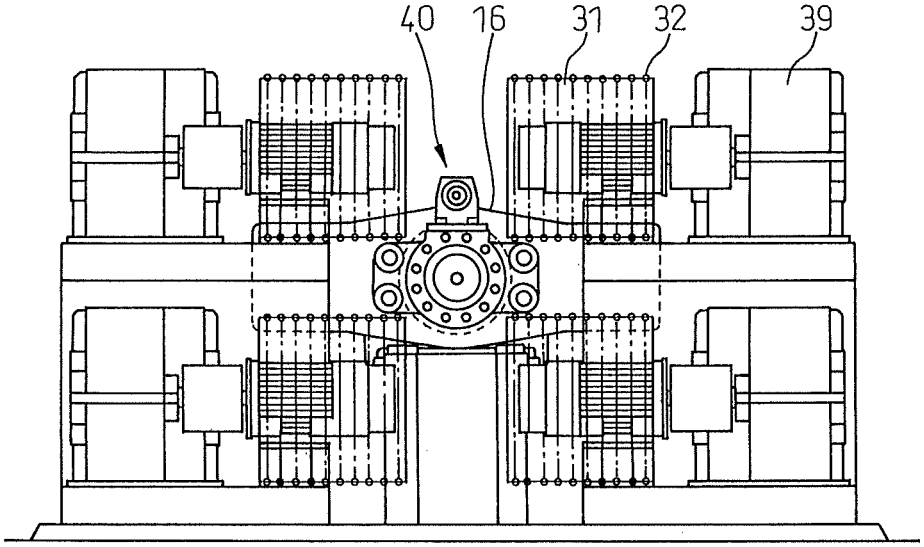
FIG. 3 is a rear view when the device in FIG. 1 is viewed from the rear thereof.
Figure 4:
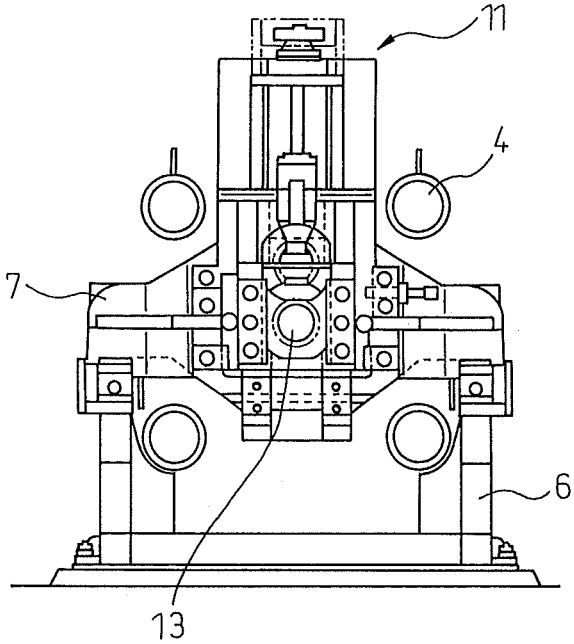
FIG. 4 is a sectional view along A-A when the device in FIG. 1 is viewed from ahead thereof.
Figure 5:
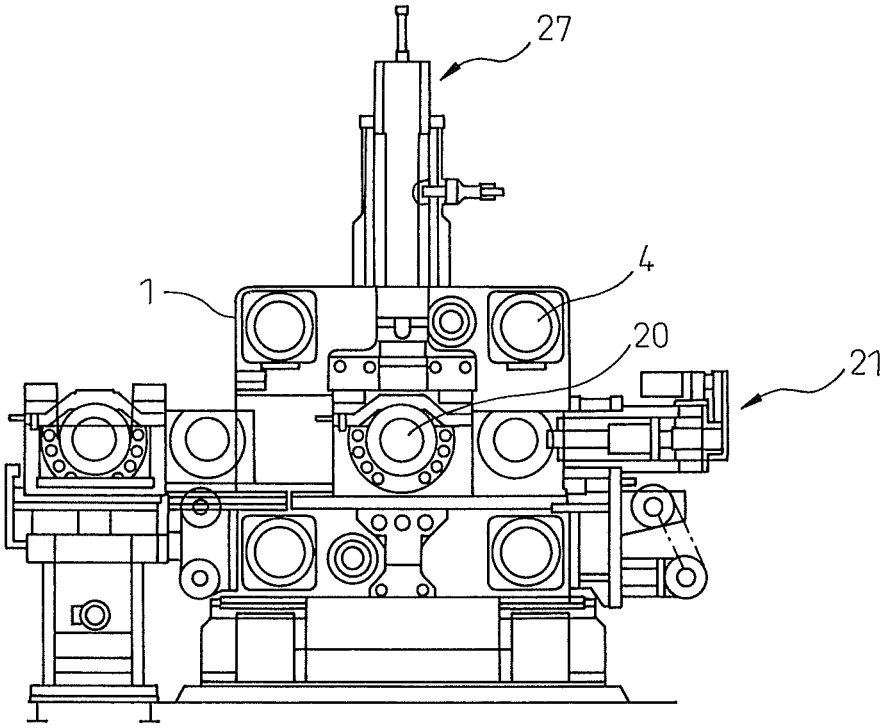
FIG. 5 is a sectional view along B-B when the device in FIG. 1 is viewed from the rear thereof.

An extrusion press of a first embodiment of the present invention is explained below in detail based on the drawings. FIG. 1, FIG. 2, FIG. 3, and FIG. 4 diagrammatically show the first embodiment (stem slide system extrusion press) of the extrusion press according to the present invention, wherein FIG. 1 is a side view showing an outline of the configuration of the extrusion press of the first embodiment, FIG. 2 is a plan view of the device in FIG. 1 when viewed from above, FIG. 3 is a rear view of the device in FIG. 1 when viewed from the rear thereof, and FIG. 4 and FIG. 5 each show a sectional view along A-A of the device in FIG. 1 when viewed from ahead thereof and a sectional view along B-B when viewed from the rear thereof. The extrusion press of the present invention molds a predetermined product by extrusion molding via a die by pressing an extrusion stem (or a stem) by an extrusion force by an electric extrusion drive (mechanism) that converts rotational motion into rectilinear motion to apply pressure to a billet at about 400 to 500° C. generally.

Referring to FIG. 1 and FIG. 2, an extrusion press 10 of the first embodiment of the present invention comprises an end platen 1 located at the front end part and a fixed platen 2 located in the vicinity of the center of the device. At the center of the end platen 1, a through hole 9 is provided through which a product is caused to pass, which product is molded by extruding a billet 8 into a predetermined shape via a die 20. In the present embodiment, as can be seen clearly from FIG. 4, the end platen 1 and the fixed platen 2 are coupled by four tie rods 4 arranged in the four corners. Between the end platen 1 and the fixed platen 2, in the vicinity of the end platen 1, a container 3 to be loaded with the billet 8 is arranged so as to be supported by a container holder (not shown schematically) and on the side of the fixed platen 2, a crosshead 7 is arranged so as to be supported by the four tie rods 4. The tie rods 4 penetrate through the four corners of the crosshead 7, respectively. Between the end platen 1 and the container 3, the die 20 is arranged. The container 3 is driven by a container operating device 14 comprising a container operating motor 17 and moves back and forth.

At the center on the side of the container of the crosshead 7, an extrusion stem (or a stem) 13 is attached. The extrusion press 10 of the present embodiment adopts the stem slide system and the extrusion stem 13 is capable of moving vertically by a stem slider 11 comprising a stem slide motor 12. In the present embodiment, the extrusion stem 13 is driven by the stem slide motor 12 and it is preferable for the stem slide motor 12 to be a speed-variable inverter motor or AC servomotor.

To the side of the fixed platen of the crosshead 7, an extrusion mobile part 15 in the shape of a hollow cylinder (may be in another shape, such as a polygon, and may be solid instead of hollow) is linked and the extrusion mobile part 15 is supported slidably by the fixed platen 2 while penetrating through the center of the fixed platen 2. To the other end part of the extrusion mobile part 15, an extrusion part 16 in the shape of a wing (may be in another shape) is attached as shown in FIG. 1.

In the present embodiment, as shown in FIG. 1 and FIG. 2, four wire drums (or drums) 31 rotatably arranged in the upper, lower, left, and right positions are arranged on the opposite side of the stem of the fixed platen 2. To the wire drum 31, a plurality (ten in the present embodiment) of wires 32 is fixed and wound on one of the end parts, respectively and the other end parts of the wires 32 are linked to the extrusion part 16, respectively. In the present embodiment, when the plurality of the wires 32 is wound to the drum 31, rotational motion is converted into rectilinear motion (the extrusion drive including the drum 31 etc. corresponds to the main cylinder part in the case of the hydraulic drive system). The wire drum 31 causes the extrusion stem 13 to move forward via the wire 32 and further, via the extrusion mobile part 15 and the crosshead 7. It may also be possible to mount one or more wire drums 31 based on the capacity of the device (extrusion press 10) and the number of the wires 32 in each wire drum 31 may be one or more based on the capacity of the device. Each wire drum 31 is driven by an electric extrusion main motor 39, which is preferably an AC servomotor, via a speed reducer 36 and a clutch coupling 38. In the extrusion drive, the wire drum 31 is linked to the output shaft of the speed reducer 36 and the input shaft of the speed reducer 36 is connected to the output shaft of the extrusion main motor 39 via the clutch coupling 38. The speed reducer 36 and the clutch coupling 38 may be other power transmitting components.

The speed when moving the extrusion stem 13 by the wire drum 31 is low because the speed is reduced considerably by the speed reducer 36. However, until the extrusion stem 13 comes into contact with the billet 8, it is preferable to move at a high speed to reduce the operation time. Further, the movement direction of the extrusion stem 13 by the wire drum 31 is only the extrusion (forward) direction, and therefore, the movement in the pull-back (backward) direction of the extrusion stem 13 is also required. Due to this, a crosshead fast moving mechanism 40 is provided. In the present embodiment, the crosshead fast moving mechanism 40 comprises a crosshead fast moving motor 35, which is preferably an AC servomotor or inverter motor, a ball nut 34, a ball screw 33, etc., and the ball screw 33 is linked to the crosshead fast moving motor 35 at one side and linked to the extrusion part 16 at the other side. In the present embodiment, the mechanism to convert the rotational motion of the crosshead fast moving motor 35 into linear motion uses the ball screw system, however, it may also be possible to use an already known mechanism, such as the rack/pinion system. In the present embodiment, as shown in FIG. 2, the crosshead fast moving mechanism 40 is fixed on and supported by the fixed platen 2 via four struts 41, however, it may be supported by another supporting method. Further, when moving the extrusion stem 13 at a high speed by the crosshead fast moving mechanism 40, the wire 32 loosens, and therefore, in order to prevent the wire 32 from loosening at this time, as shown in FIG. 1, a wire winding device 42 is provided to each wire drum 31 and a wire winding motor 43 of the wire winding device 42 is connected to the wire drum 31 via a chain, etc. The wire winding motor 43 is operated to drive the wire drum 31 so as to prevent the wire 32 from loosening at the same time as the crosshead fast moving motor 35 is operated.

The extrusion press 10 comprises a machine base 6 and on the machine base 6, the end platen 1, the fixed platen 2, the wire drum 31, the speed reducer 36, the extrusion main motor 39, etc., are installed and fixed. In the center of the extrusion press 10, a center axis line C extends in the lengthwise direction as shown in FIG. 1 and FIG. 2 and the extrusion press 10 has a configuration substantially bilaterally symmetric about the center axis line C. In the extrusion molding stage, the end platen 1, the fixed platen 2, the container 3, the extrusion stem 13, the crosshead 7, and the extrusion mobile part 15 are arranged so that each center axis thereof agrees with the center axis line C.

Further, the extrusion press comprises a billet loader (not shown schematically) configured to supply the billet 8 between the container 3 and the extrusion stem 13, a shear device 27 (mounted on the end platen 1) configured to cut a discard, which is an unnecessary part at the end part of the product after extrusion molding of the billet 8, a die slide device (shear) 21 configured to move a die, etc.

Figure 9:
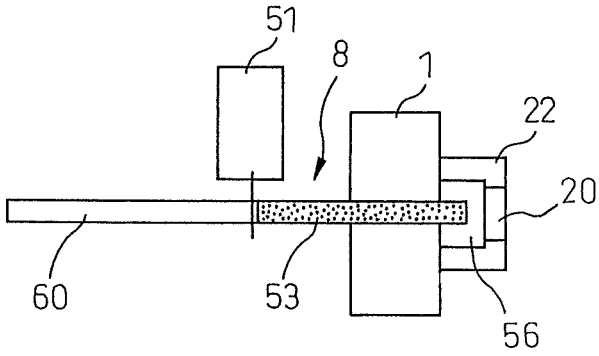
FIG. 9 is an explanatory diagram of an operation of a die slide device.
Figure 9:
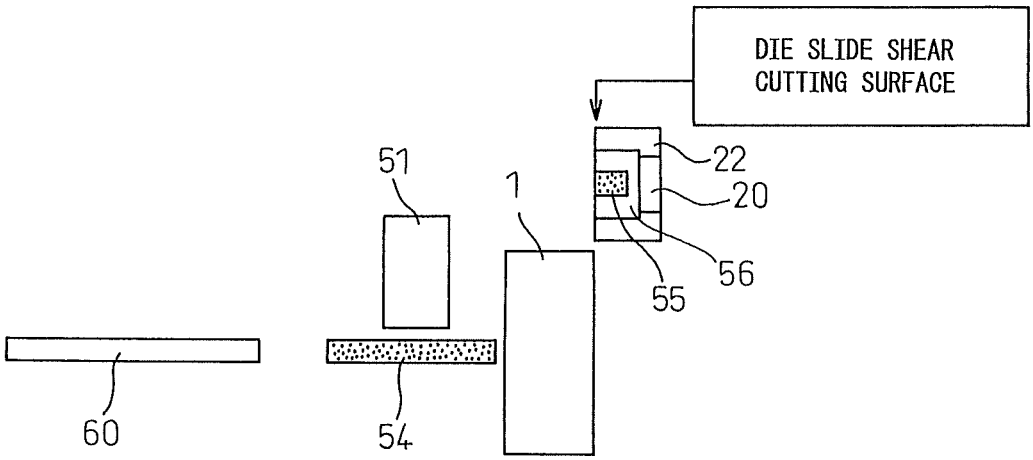

The use and purpose of the die slide device (shear) 21 is to move the die (20) in the transverse direction perpendicular to the center axis line (C) and to cut and separate a product 60 extruded toward the rear of the end platen at the time of completion of extrusion from the die 20. In the actual operation, by using a platen saw 51 installed ahead of the end platen on the front installation side, the product 60 is cut at the time of completion of extrusion (see FIG. 9). After that, the product 60 is sent to the front table by the drive installed ahead thereof. At this time, a remaining material 53 of the product 60 remains within the end platen in the state of being molded by the die (see FIG. 9). When moving the die slide 22 to the die replacement position by the die slide device 21 to replace the die 20 with another, a remaining material 54 of the product is cut and separated from a die stack 56 at the cutting surface of the front surface of the end platen and the front surface of the die slide 22 (see FIG. 9). A remaining material 55 within the die stack 56 is cut and separated from the die 20 by another cutting device or manual operation after the die stack 56 is sent out of the machine.

The container 3 is reciprocated (move forward and back) by the container operating motor 17, which is preferably an inverter motor or AC servomotor, via the mechanism including the ball screw and the ball and configured to convert rotational motion into linear motion. In the case of the front loading system (second embodiment to be described below), on the opposite side of the extrusion stem of the fixed platen, the container operating device 14, such as the container operating motor 17, is provided. This is because the movement stroke of the container is large. In the shear device 27, an electric motor is used as a power source and rotational motion is converted into rectilinear motion via the winding drive mechanism, such as a chain. The die slide device (shear) 21 uses an electric motor as a power source and converts rotational motion into rectilinear motion via the power transmission mechanism including the ball screw and the ball nut. The stem slider also uses an electric motor as a motor source and uses the mechanism configured to convert rotational motion into rectilinear motion via the power transmission mechanism including the ball screw and the ball nut. The die changer configured to change the die and the billet loader also use an electric motor as a power source. With this configuration, it is possible to operate the extrusion press only by electric power.

The extrusion press 10 of the present embodiment is explained using a stem slide extrusion press belonging to the short stroke rear loading system as an example, however, it is clear that persons skilled in the art can easily understand that the present invention can be applied to the short stroke front loading system and the conventional system with no stem slider mounted. Further, the configuration of the present invention is explained using the direct extrusion press as an example, however, it is clear that persons skilled in the art can easily understand that the present invention can also be applied to the indirect extrusion press.

Figure 6A:
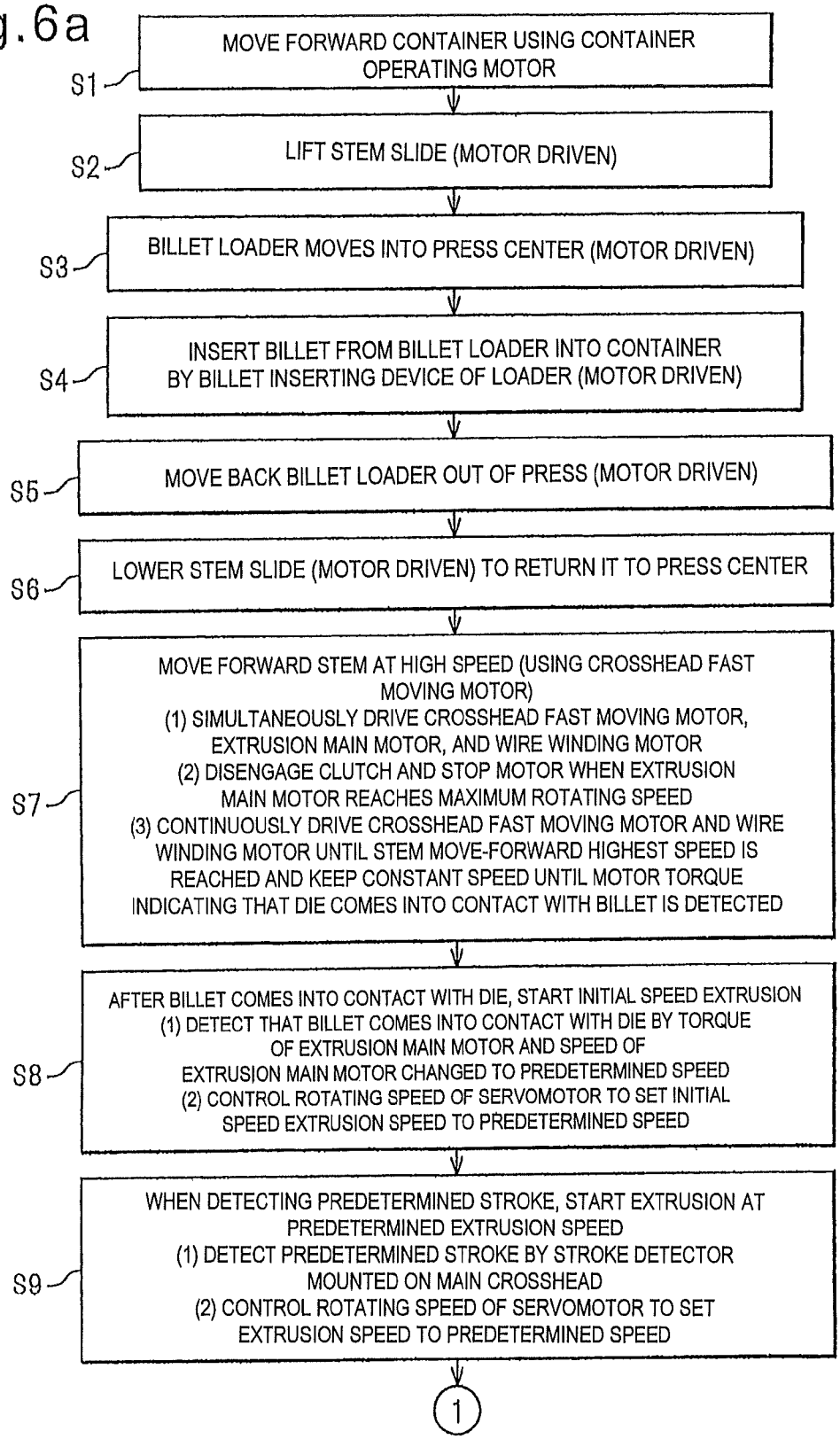
FIG. 6 is a flowchart showing an operation process of the extrusion press of the first embodiment of present invention.
Figure 6B:
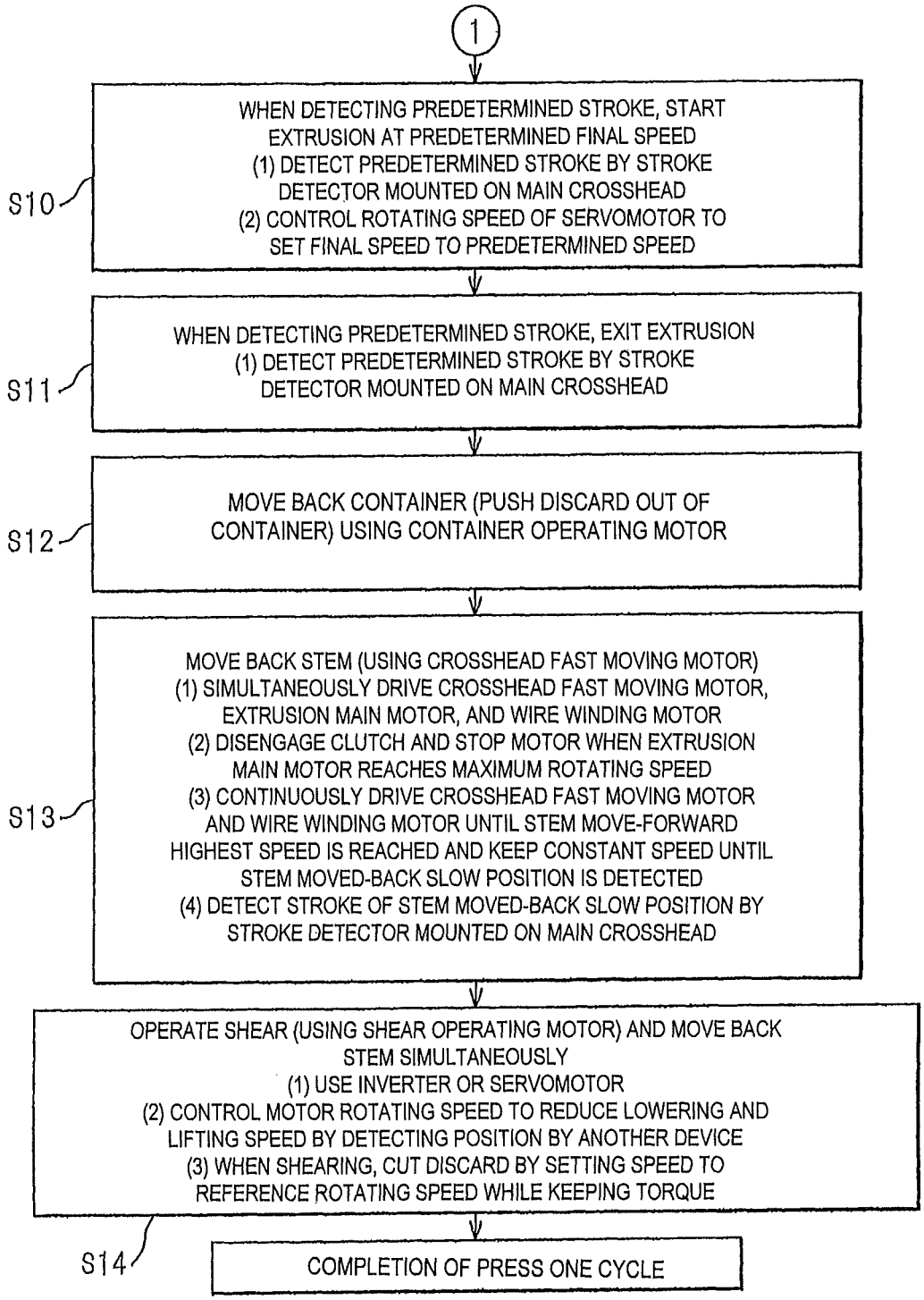

Next, the operation of the stem slide (short stroke rear loading system) extrusion press 10 of the present embodiment is explained with reference to FIG. 6.

The operation of the extrusion press 10 performs one cycle repeatedly and produces the mold product continuously. In the present embodiment, in step S1 (S1), the extrusion press 10 is in the stage in which one cycle of the extrusion molding process is completed and the container 3 has moved back and is in the state of being distant from the die 20. In S1, the cycle of the next new extrusion molding process is started and first, the container operating motor 14 is operated and thereby the container 3 is moved forward and connected to the die 20. Next, in step 2 (S2), by lifting the stem slider 11 to lift the extrusion stem 13, a sending-in space of the billet 8 is provided to send in the billet 8.

Next, in step 3 (S3), by the billet loader (electric motor driven), the billet 8 is sent into the extrusion press center between the container 3 and the crosshead 7. Next, in step 4 (S4), the billet 8 held by the billet loader is inserted into the container 3 by the billet inserting device (electric motor driven) of the billet loader. Next, in step 5 (S5), the billet loader is moved out of the extrusion press 10. Next, in step 6 (S6), by lowering the stem slider 11, the extrusion stem 13 is arranged in the press center. The billet 8 within the container 3 and the extrusion stem 13 are aligned on the center axis line C.

Next, in step 7 (S7), the extrusion stem 13 is caused to move forward at a high speed and to substantially come into contact with the billet 8. In this procedure, first, the load to move the extrusion stem 13 is heavy, and therefore, the crosshead fast moving motor 35 and the extrusion main motor 39 are operated to cause the extrusion stem 13 to start to move forward (with this configuration, it is possible to make small the capacity of the crosshead fast moving motor 35). When the extrusion mobile part 15 and the crosshead 7 start to move, the clutch of the clutch coupling 38 is disengaged and the extrusion main motor 39 is stopped. Then, the crosshead fast moving motor 35 and the wire winding motor 43 are driven continuously until the extrusion stem move-forward highest speed is reached and the extrusion stem 13 and the billet 8 move forward at constant speed until the billet 8 comes into contact with the die 20. In the present embodiment, the state in which the die 20 comes into contact with the billet 8 is detected by the torque of the extrusion main motor 39, however, it may also be possible to detect by another already known means, such as a stroke sensor and limit switch.

Next, in step 8 (S8), the initial speed extrusion is started by causing the extrusion main motor 39 to drive the drum 31. The initial speed and the subsequent speed of extrusion are set in advance and in the present embodiment, the extrusion main motor 39 is an AC servomotor, and therefore, the speed adjustment is performed by controlling the rotating speed. Next in step 9 (S9), when detecting that a predetermined advance stroke is reached, the rotating speed of the extrusion main motor 39 is controlled so that a predetermined extrusion speed is obtained. The predetermined stroke is detected by a stroke detector provided to the crosshead 7, however, it may also be possible to detect the predetermined stroke by the rotating speed of the extrusion main motor 39 or the drum 31 and by another already known means, such as the limit switch. Next, in step 10 (S10), the predetermined advance stroke is detected by the stroke detector and the rotating speed of the extrusion main motor 39 is controlled so that a predetermined extrusion final speed is obtained. Next, in step 11 (S11), the state in which the predetermined advance stroke is reached is detected by the stroke detector, the extrusion main motor 39 and the crosshead fast moving motor 35 are stopped, and the extrusion is exited.

Next, in step 12 (S12), by operating the container moving motor 17 to move back the container and the discard (defective part at the rear end of the extrusion-molded product) is pushed out of the container 3. Next, in step 13 (S13), the extrusion stem 13 is moved back by operating the crosshead fast moving motor 35 up to the position where the next billet 13 can be sent in. At this time, the extrusion main motor 39 and the wire winding motor 43 are also operated at the same time, however, the extrusion main motor 39 is used only to initially move the drum 31 and when the speed of the crosshead fast moving motor 35 reaches the maximum rotating speed, the clutch coupling 38 is disengaged and the extrusion main motor 39 is stopped. After that, the crosshead 17 is continuously moved back at the highest speed by operating the crosshead fast moving motor 35 and the wire winding motor 43 and at the same time, the wire 32 wound to the drum 31 is extended. Until the stem moved-back slow position is detected by the stroke detector, the crosshead 7 is moved back at a constant speed and after the stem moved-back slow position is detected, the speed of the move-back is reduced.

Next, in step 14 (S14), the shear device 27 is operated and the discard is cut from the product and removed. It is preferable to drive the shear device 27 by an inverter motor or AC servomotor. The movement (downward) of the shear of the shear device 27 at the time of cutting is set so that the speed thereof is high until the shear comes into contact with the discard and after the contact (a predetermined position is detected by a shear position detector), the speed is reduced so as to keep the torque of the drive motor. It is preferable to lift the shear at a high speed. In step 14, one cycle of the extrusion press is completed and the procedure returns to S1 again.

Figure 7A:
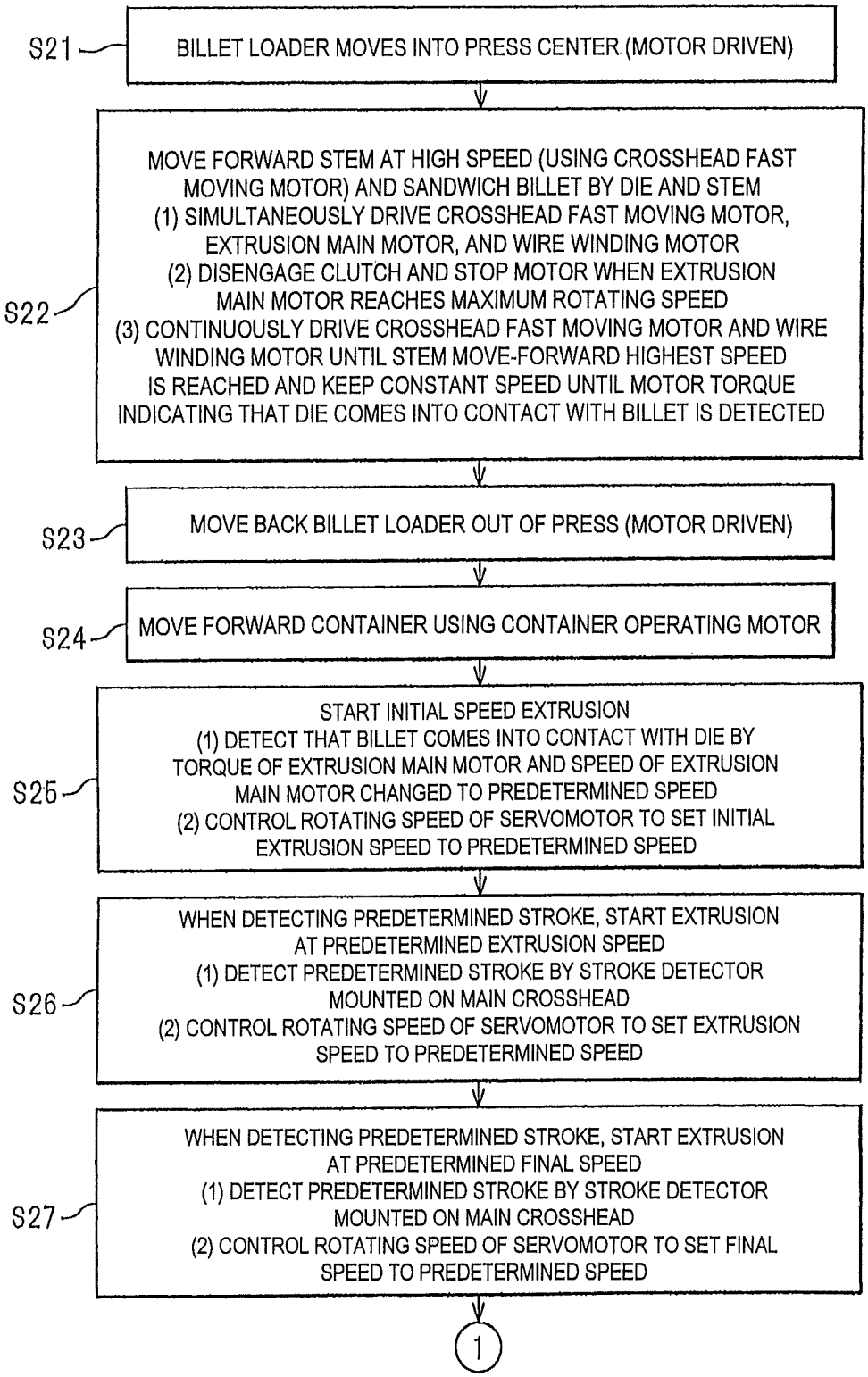
FIG. 7 is a flowchart showing an operation process of an extrusion press of a second embodiment of present invention.
Figure 7B:
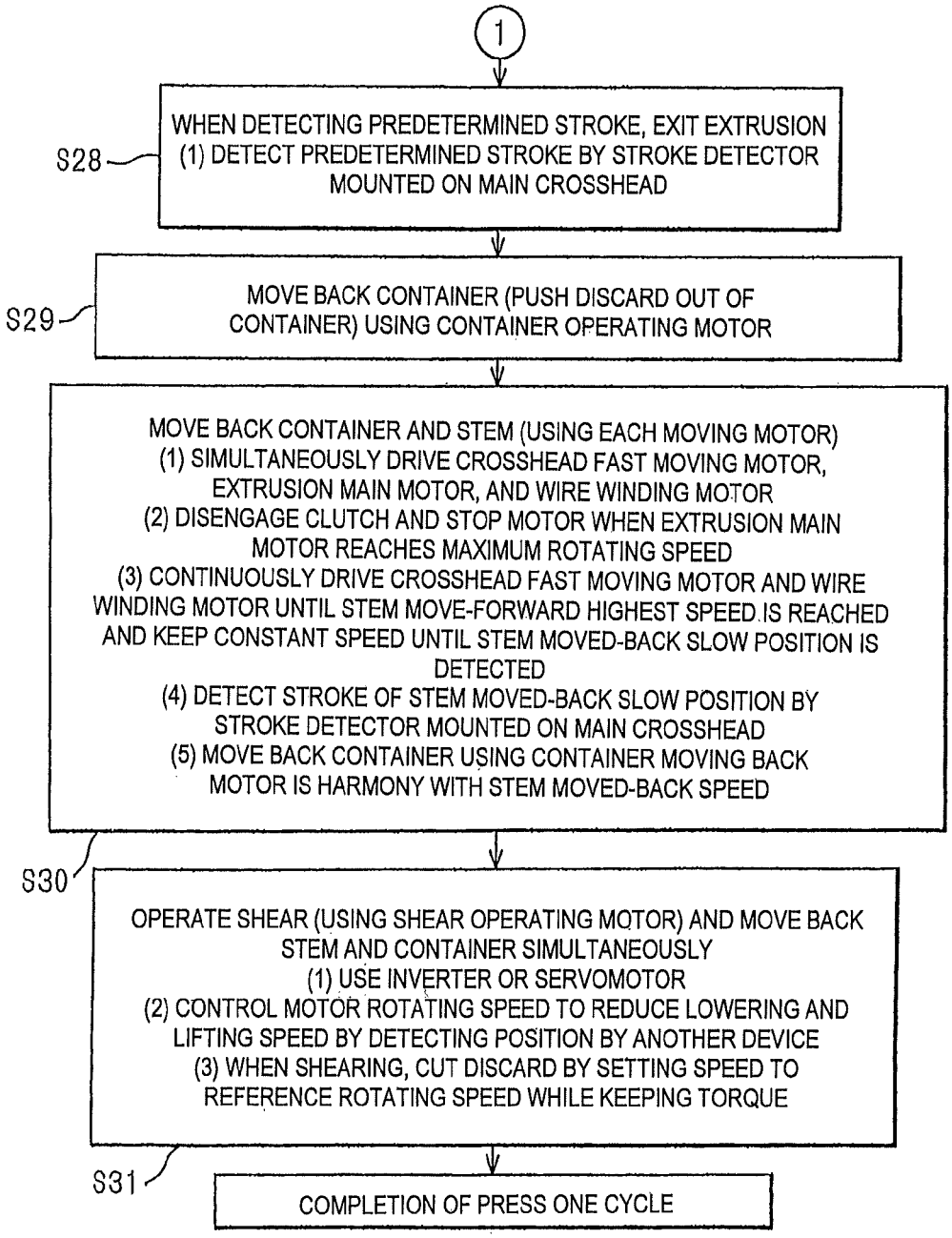

Referring to FIG. 7, an operation flow of an extrusion press of a second embodiment of the present invention is shown. The extrusion press 10 of the second embodiment of the present invention adopts the front loading system. In the front loading extrusion press, the space for loading the billet 8 between the die 20 and the container 3 is provided by moving the container 3 to the side of the extrusion stem 13 (in the stem slide system (rear loading system), the space is provided between the container 3 and the crosshead 7 by lifting the extrusion stem 13). In the front loading system also, the mechanism, etc., to extrude the extrusion stem 13 (or the crosshead 7) relating to the present invention is the same as that in the stem slide system, and therefore, explanation of the detailed configuration of the front loading extrusion press is omitted (see Patent Document 2).

The operation flow of the present embodiment is explained below.

In step 21 (S21), which is the first step in the operation flow, the extrusion press 10 is in the stage in which one cycle of the extrusion molding process is completed and the stage in which the cycle of the next new extrusion molding process is started. Before the start of S21, the container 3 is moved back by the container operating motor 17 and the extrusion stem 13 is accommodated within the container 3, and therefore, a space is already provided between the die 20 and the container 30. In S21, the billet loader holding the billet 8 is moved into the machine in the vicinity of the extrusion press and the billet 8 held by the billet loader as if it were supported thereby is moved to the center of the extrusion press (press center) between the die 20 and the container 3. The container is still in the state of being moved back and distant from the die 20.

Next, in step 22 (S22), the extrusion stem 13 is moved forward at a high speed and the extrusion stem 13 is caused to substantially come into contact with the billet 8 and further, the billet 8 in the state of being supported by the billet loader is pushed until it comes into contact with the die 20 and sandwiched by the die 20 and the extrusion stem 13 and thus held. In this procedure, first, the load to start movement is heavy, and therefore, the crosshead fast moving motor 35 and the extrusion main motor 39 are operated to start forward movement (with this configuration, it is possible to reduce the capacity of the crosshead fast moving motor 35). When the extrusion mobile part 15 and the crosshead 17 start to move and the speed of the extrusion main motor 39 reaches the maximum rotating speed, the clutch of the clutch coupling 38 is disengaged and the extrusion main motor 39 is stopped. Then, the crosshead fast moving motor 35 and the wire winding motor 43 are driven continuously until the extrusion stem move-forward highest speed is reached and the extrusion stem 13 and the billet 8 are moved forward at constant speed until the billet 8 comes into contact with the die 20. In the present embodiment, the state in which the billet 8 comes into contact with the die 20 is detected by the torque of the extrusion main motor 39, however, it may also be possible to detect the contact by another already known means, such as the stroke sensor, limit switch, and extrusion stem load sensor.

Next, in step 23 (S23), the billet loader is moved out of the extrusion press 10. Next, in step 24 (S24), the container moving motor 14 is operated and the container 3 is moved forward and connected to the die 20. The state at this time is the state when S7 is completed in the first embodiment.

After that, steps 25, 26, 27, and 28 are carried out sequentially. The contents of these procedures (steps) are the same as those in S8, 9, 10, and 11 in the first embodiment. That is, in step 25 (S25), the extrusion main motor 39 is caused to drive the drum 31 and the initial extrusion is started. In step 26 (S26), that the predetermined advance stroke is reached is detected and the rotating speed of the extrusion main motor 39 is controlled so that a predetermined extrusion speed is obtained. In step 27 (S27), the predetermined advance stroke is detected by the stroke detector and the rotating speed of the extrusion main motor 39 is controlled so that a predetermined extrusion final speed is obtained. In step 28 (S28), that the predetermined advance stroke is reached is detected by the stroke detector and the extrusion main motor 39 and the crosshead fast moving motor 35 are stopped and then the extrusion is exited. The contents of S25 to S28 are the same as those of S8 to S12 in the first embodiment, and therefore, detailed explanation is omitted to avoid duplication. Next, in step 29 (S29), the container moving motor 17 is operated to move back the container 3 and then the discard (defective part at the rear end of the extrusion molded product) is pushed out of the container 3.

Next, in step 30 (S30), the container 3 and the extrusion stem 13 are moved back. In S31, the crosshead fast moving motor 35 is operated up to the position where the next billet 8 can be sent in and the extrusion stem 13 is moved back. At this time, the extrusion main motor 39 and the wire winding motor 43 are also operated at the same time, however, the extrusion main motor 39 is used only to start to move the drum 31 and when the speed of the crosshead fast moving motor 35 reaches the maximum rotating speed, the clutch coupling 38 is disengaged and the extrusion main motor 39 is stopped. After that, the crosshead fast moving motor 35 and the wire winding motor 43 are operated and the crosshead 7 is moved back continuously at the highest speed and at the same time, the wire 32 wound to the drum 31 is extended. Until the stem moved-back slow position is detected by the stroke detector, the crosshead 7 is moved back at a constant speed and after the stem moved-back slow position is detected, the move-back speed is reduced. The procedure to operate the extrusion main motor 39, etc., of step S31 is similar to that of S13 in the first embodiment. The container 3 is moved back by using the container moving motor 17 in such a manner that the move-back speed is in harmony with that of the extrusion stem 13.

Next, in step 31 (S31), the shear device 27 is operated and the discard is cut from the product and removed. The contents of S31 are the same as those of S14 in the first embodiment, and therefore, details are omitted to avoid duplication. In step 31, one cycle of the extrusion press in the present embodiment is completed and the procedure returns to S21 again.

Figure 8A:
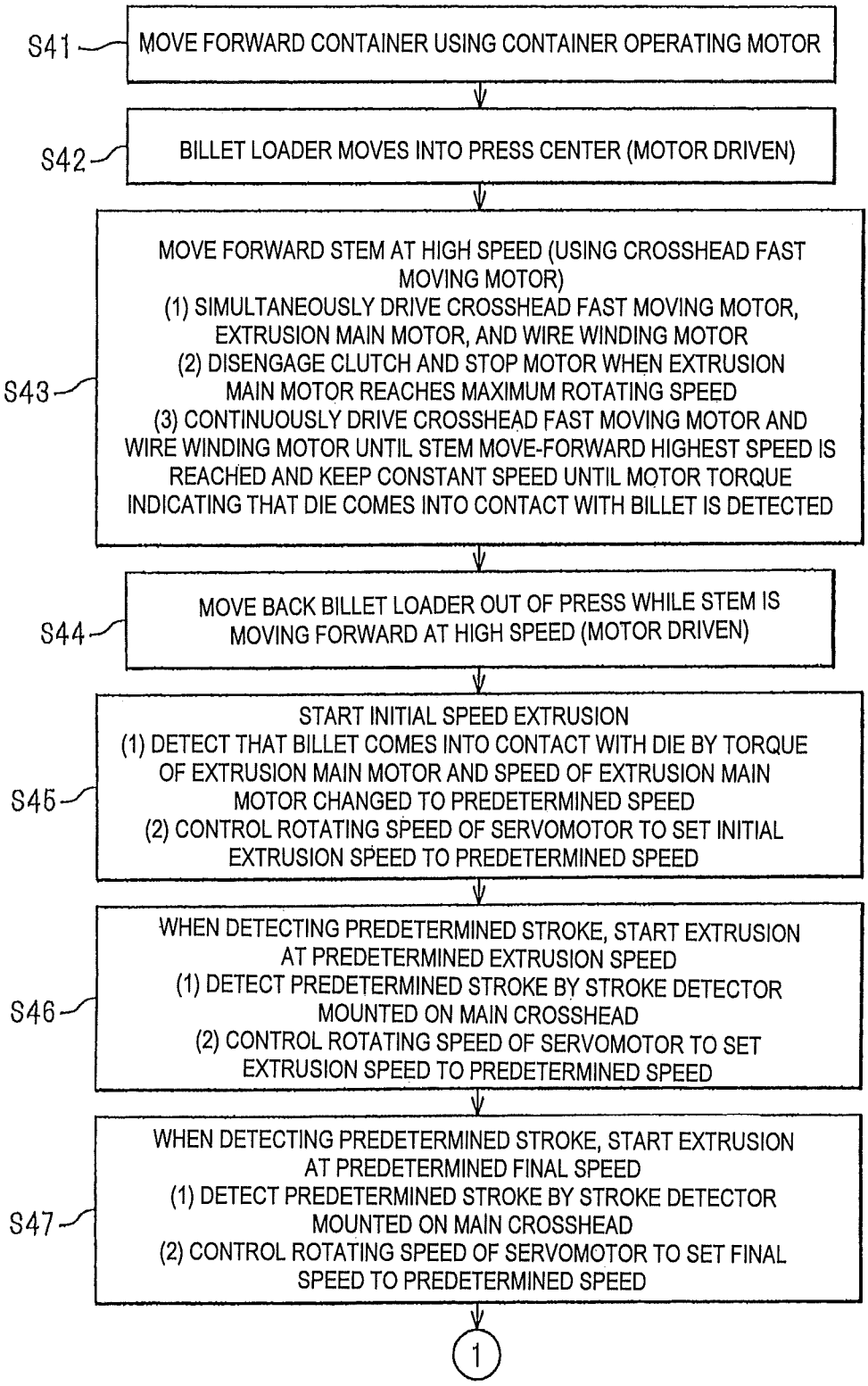
FIG. 8 is a flowchart showing an operation process of an extrusion press of a third embodiment of present invention.
Figure 8B:
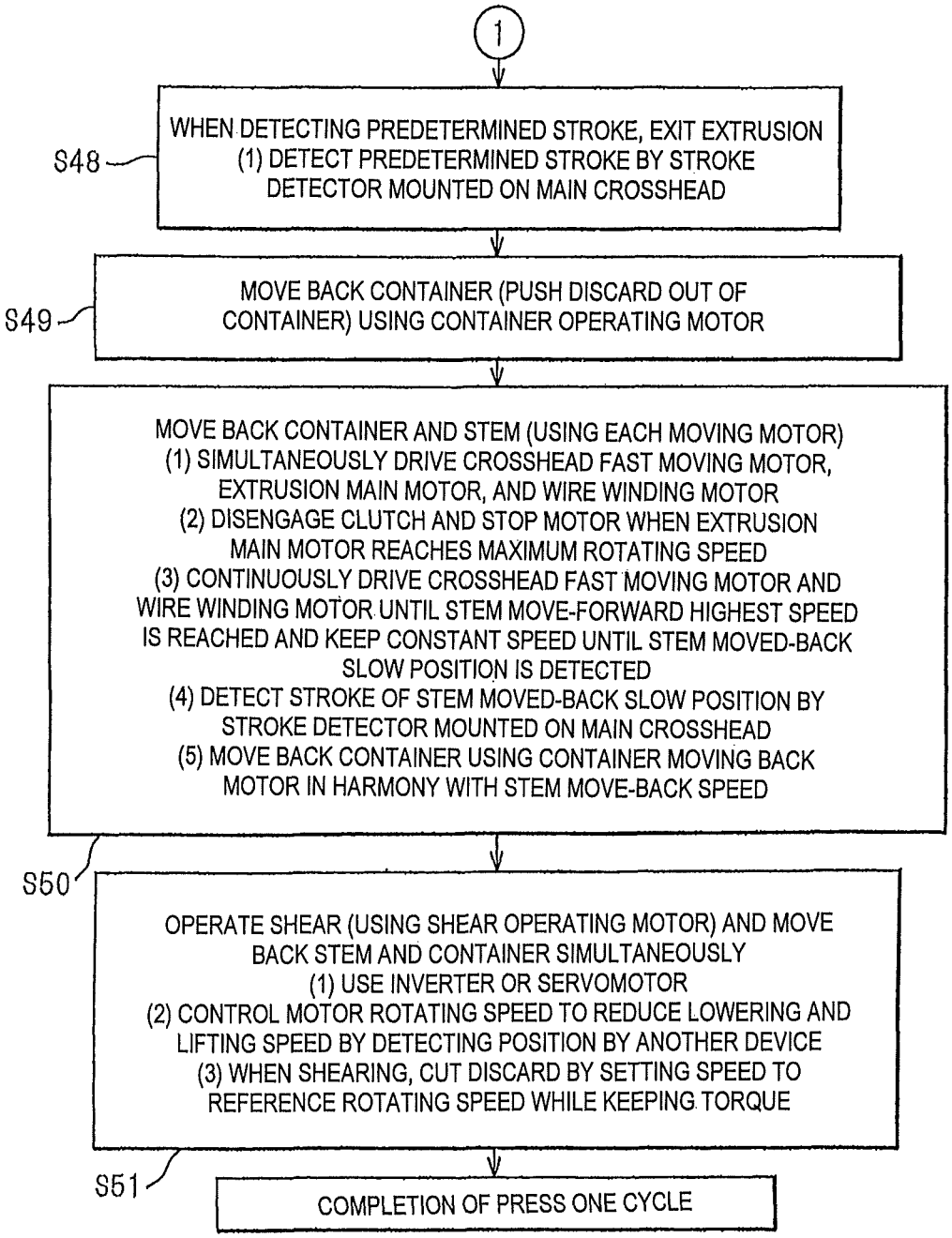

Referring to FIG. 8, an operation flow of an extrusion press of a third embodiment of the present invention is shown. The extrusion press of the third embodiment of the present invention adopts the conventional system. The configuration of the conventional extrusion press is such that between the extrusion stem 13 and the container 3, a sufficient space for sending in the billet 8 exists and it is not necessary to move the extrusion stem 13 or the container 3 to another place. Consequently, in the conventional system, the device is increased in length. On the contrary, the stem slide extrusion press and the front loading extrusion press are devised to reduce the length of the conventional system. Consequently, the operation of the conventional system is basically the same as that of the stem slide system. The configuration of the conventional extrusion press is such that the stem slider 11 is removed in the stem slide extrusion press 10. That is, in the conventional extrusion press, the extrusion stem 13 is fixed on the crosshead 7.

The operation flow of the present embodiment is explained below.

Step 41 (S41) is the same as step 1 (S41) in the stem slide system and the step of starting one cycle of the new extrusion molding process, in which the container operating motor 14 is operated and the container 3 is moved forward and connected to the die 20. Next, in step 42 (S42), by the billet loader (electric motor driven), the billet 8 is sent into the extrusion press center between the container 3 and the crosshead 7 (or the extrusion stem 13) (step 2 in the stem slide system is no longer necessary).

Next, in step 43 (S43), the extrusion stem 13 is moved forward at a high speed, the extrusion step 13 is caused to substantially come into contact with the billet 8, and further, the billet 8 in the state of being supported by the billet loader is pushed until the billet 8 comes into contact with the die 20 and the billet 8 is sandwiched by the die 20 and the extrusion stem 13 and thus held. S43 is the same as step 22 (S22) in the front loading system and step 7 (S7) in the stem slide system, and therefore, detailed explanation is omitted. Next, in step 44 (S44), the billet loader is moved out of the extrusion press.

After that, steps 45, 46, 47, 48, and 49 are performed sequentially. The contents of these procedures (steps) are the same as the procedures (steps) of S8, 9, 10, 11, and 12 in the first embodiment (and S25, 26, 27, 28, and 29 in the second embodiment). That is, in step 45 (S45), the drum 31 is driven by the extrusion main motor 39 to start the initial speed extrusion. In step 46 (S46), that the predetermined advance stroke is reached is detected and the rotating speed of the extrusion main motor 39 is controlled so that the predetermined extrusion speed is obtained. In step 47 (S47), the predetermined advance stroke is detected by the stroke detector and the rotating speed of the extrusion main motor 39 is controlled so that the predetermined extrusion final speed is obtained. In step 48 (S48), that the predetermined advance stroke is reached is detected by the stroke detector, the extrusion main motor 39 and the crosshead fast moving motor 35 are stopped, and the extrusion is exited. In step 49 (S49), the container moving motor 17 is operated to move back the container and the discard (defective part at the rear end of the extrusion-molded product) is pushed out from the container 3. The contents of S45 to S49 are the same as those of S8 to S12 in the first embodiment, and therefore, a detailed explanation is omitted to avoid duplication.

Next, in step 50 (S50), the container 3 and the extrusion stem 13 are moved back. S50 is the same as step 30 in the second embodiment, and therefore, detailed explanation is omitted to avoid duplication. Next, in step 51 (S51), the shear device 27 is operated and the discard is cut from the product and removed. The contents of S51 are the same as those of S14 in the first embodiment and those of S31 in the second embodiment, and therefore, detailed explanation is omitted to avoid duplication. In step 51, one cycle of the operation process of the extrusion press in the present embodiment is completed and the procedure returns to S41 again.

In the second and third embodiments, the same as or similar component to the component in the first embodiment is specified by the same reference symbol.

The effects and workings of the embodiments described above are explained.

By the extrusion press in the first embodiment of the present invention, the following effects can be expected.

The extrusion press includes a number of mobile elemental devices and is operated by operating each elemental device in a variety of ways, and in the present invention, each elemental device is driven by the electric motor, and therefore, it is possible to operate the motor only when each elemental device needs to be operated. Due to this, the effect of reducing electric power can be expected (in the hydraulic system, in general, the idling is necessary even when the operation is not required).

Since the electric motor is used as a drive source, the drive itself is the electric motor, and therefore, it is only necessary to maintain the electric motor itself and the time and cost for maintenance and management are reduced because the number of parts to be maintained is small compared to that of the hydraulic source.

Spill of hydraulic oil does not occur and noise can be reduced, and therefore, the working environment is improved and the risk of fire can be avoided.

By the use of the AC servomotor, etc., precise positional control, etc., is excellent and operability is improved.

By the extrusion press in the second and third embodiments of the present invention, the same effects as those in the first embodiment can be expected.

In the explanation described above, the extrusion press of the present invention is explained using an example of the direct extrusion press, however, the present invention may be applied to an indirect extrusion press.

The embodiments described above are mere examples of the present invention and the present invention is not limited by the embodiments but specified only by claims and embodiments other than those described above can be embodied.

While the invention has been described by reference to specific embodiments chosen for the purposes of illustration, it should be apparent that numerous modifications could be made thereto, by those skilled in the art without departing from the basic concept and scope of the invention.

The invention claimed is:

1. An extrusion press comprising:

an end arranged at a front end part in the lengthwise direction of the extrusion press;

a fixed platen arranged at the rear in the lengthwise direction in opposition to the end platen;

a tie rod configured to link the end platen and the fixed platen;

a die arranged so as to come into contact with a rear surface of the end platen;

a container arranged in opposition to the die and loaded with a billet;

an extrusion stem configured to press the billet loaded within the container;

a crosshead arranged ahead of the fixed platen and to the front surface of which the extrusion stem is attached;

an extrusion drive configured to drive the crosshead and the extrusion stem attached to the crosshead to reciprocate in the forward and backward directions;

an extrusion mobile part one end part of which is linked to the crosshead; and an extrusion part attached to the other end part of the extrusion mobile part and on which the other end part of the wire is fixed;

the extrusion press further comprises:

a crosshead fast moving mechanism capable of reciprocating the extrusion mobile part back and forth; and a wire winding device, separately from the extrusion drive, capable of winding the wire to the wire drum and feeding the wire therefrom by rotating the wire drum in the forward and reverse directions, wherein by pushing the extrusion stem by an extrusion force of the extrusion drive, a pressure is applied to the billet and the billet is extruded via the die and, thus, a predetermined product is molded by extrusion molding, the extrusion drive comprises one or more wire drums provided rotatably and one end part of one or more wires is fixed on the wire drum and at the same time, the other end part of the wire is connected mechanically to the crosshead, by rotating the wire drum to wind the wire, the crosshead and the extrusion stem are driven to move forward, and the wire drum is driven by an electric extrusion main motor, and wherein, in the stage at the time of start of the extrusion molding process, in which the billet has moved forward and come into contact with the die but no load of extrusion molding acts on the extrusion stem, when moving back the extrusion stem and causing the extrusion stem to move forward and back at a high speed, the extrusion stem is driven at a high speed via the extrusion mobile part by the crosshead fast moving mechanism and at the same time, the wire winding device is operated to wind and feed the wire.

2. The extrusion press according to claim 1, wherein when starting the operation to drive the extrusion stem at a high speed, the extrusion drive is operated together with the crosshead fast moving mechanism.

3. The extrusion press according to claim 1, wherein the extrusion press further comprises:

a container moving device using an electric motor as a drive source and capable of driving the container in the forward and backward directions;

a shear device using an electric motor as a drive source and configured to cut a discard; and a die slide device using an electric motor as a drive source and capable of moving the die.

4. The extrusion press according to claim 1, wherein the extrusion main motor connects to the wire drum via a clutch coupling and a speed reducer.

5. The extrusion press according to claim 1, wherein the extrusion press further comprises a stem slider using an electric motor as a drive source and capable of moving the extrusion stem in order to provide a space for sending in the billet between the crosshead and the die.

6. The extrusion press according to claim 1, wherein the extrusion main motor is an AC servomotor.

* * * * *